C5192 OR 4,547,221

United States Patent [19]

Norman

[11] Patent Number: 4,547,221

[45] Date of Patent: Oct. 15, 1985

[54] ABRASION-RESISTANT REFRIGERATION-HARDENABLE FERROUS ALLOY

[76] Inventor: Telfer E. Norman, 63893 Sunset Dr., Bend, Oreg. 97701

[21] Appl. No.: 665,446

[22] Filed: Oct. 26, 1984

[51] Int. Cl.[4] ..... C22C 37/08

[52] U.S. Cl. ..... 75/128 C; 75/125; 75/128 D; 148/35

[58] Field of Search ..... 75/123 CB, 128 D, 126 A, 75/128 C, 125, 128 W; 148/35, 3, 125, 138

[56] References Cited

U.S. PATENT DOCUMENTS

| | | | |
|---|---|---|---|
| 3;489,551 | 1/1970 | Fletcher et al. | 75/128 W |
| 3,663,214 | 5/1972 | Moore et al. | 148/35 |
| 3,941,589 | 3/1976 | Norman et al. | 148/35 |
| 3,961,994 | 6/1976 | Thome | 148/35 |
| 4,382,828 | 5/1983 | Henych | 148/3 |
| 4,395,284 | 7/1983 | Dawson | 75/123 CB |

FOREIGN PATENT DOCUMENTS

| | | | |
|---|---|---|---|
| 61235 | 9/1982 | European Pat. Off. | 75/128 D |
| 2230864 | 1/1973 | Fed. Rep. of Germany | 75/126 A |
| 65116 | 5/1979 | Japan | 148/35 |
| 47545 | 4/1981 | Japan | 75/123 CB |
| 378494 | 6/1973 | U.S.S.R. | 75/125 |

*Primary Examiner*—Peter K. Skiff

*Attorney, Agent, or Firm*—Chernoff, Vilhauer, McClung, Birdwell & Stenzel

[57] ABSTRACT

An abrasion-resistant high-chromium type of alloyed white iron, which can be hardened and toughened by refrigeration at sub-zero temperatures, containing as its essential alloying constituents about 2.6% to about 3.6% carbon, about 12% to about 22% chromium, about 0.5% to about 1.1% manganese, about 1.0% to about 3.0% molybdenum, about 0.5% to about 1.5% copper, about equal amounts of nickel and silicon in the range from about 1.4% to about 2.5% of each, and the balance iron along with conventional residual elements and incidental impurities present in usual amounts.

11 Claims, No Drawings

ABRASION-RESISTANT REFRIGERATION-HARDENABLE FERROUS ALLOY

BACKGROUND OF THE INVENTION

This invention falls within the general classification of high-chromium abrasion-resistant white irons. In the early 1920's a white iron containing about 25% to 30% chromium and about 2.5% to 3.0% carbon was developed and produced by a number of foundries for castings exposed to severe abrasion, or corrosion plus abrasion, such as occurs in centrifugal pumps handling sand or ground coal slurries. It was found to have much better abrasion resistance than the unalloyed or low-chromium white irons commonly used in abrasive service at that time.

In 1949 a technical paper by R. D. Haworth, (Trans. Amer. Soc. for Metals, 41, (1949), 819–869.) indicated that a 15% chromium white iron, with a martensite-austenite matrix, had better abrasion resistance than the 25% to 30% chromium white iron with a similar matrix. Haworth's wear tests were conducted in a "Rubber Wheel Abrasion Test Machine" (RWAT) which exposed the test specimens to a "low-stress" scratching type of abrasion by wet silica sand.

As a follow-up of Haworth's tests, I investigated a series of 12% to 20% chromium white irons, cast into grinding balls 3-inches to 5-inches diameter, in the "Marked Ball Wear Test" (MBWT) which I had developed and which is described in Metals Technology, Trans. AIME, T.P. 2319, April 1948. The 12 to 20% chromium white irons contained up to about 3% nickel or up to about 4% molybdenum or a combination of about 2% molybdenum plus about 2% nickel, which effectively suppressed the formation of pearlite in the cast balls made from the 12% to 20% chromium white irons.

A large number of MBWT's, on the foregoing series of 12% to 20% chromium white iron balls, were conducted between 1949 and 1955. These tests indicated that for best abrasion resistance, combined with relatively good toughness, the high-chromium white irons should have a microstructure consisting of $Cr_7C_3$-type carbides in a matrix of martensite, or austenite plus martensite. Pearlite in this matrix was undesirable and could be effectively suppressed by additions of up to about 3% nickel, or up to about 3% manganese, or up to about 3% molybdenum, or a combination of about 2% molybdenum plus 1% to 2% nickel. However it was found that the nickel and manganese additions tended to over-stabilize the austenite in the matrix of these irons, which in turn tended to injure their abrasion resistance. On the other hand, the molybdenum addition tended to improve the abrasion resistance of the austenite-martensite matrix in these irons, so molybdenum, in amounts up to about 3%, became the preferred addition for suppression of pearlite in the 12% to 20% chromium white irons. These irons eventually became known in the foundry industry as the 15Cr-3Mo types of white irons and will be so designated here.

It was further found by the wear tests and metallographic studies of the balls used in the MBWT that silicon, which is a common constituent in the 15Cr-3Mo types of white irons, tended to promote the formation of pearlite in the matrix, so its presence in these irons was limited to a preferred range of 0.3% to 0.8%.

During the period from about 1955 to 1965 the use of the 15Cr-3Mo types of white iron in abrasion-resistant castings grew rapidly, so ASTM standards specifications for these 15Cr-3Mo types were prepared and accepted by the ASTM Administrative Committee on Standards, in August 1965. The specification is known as ASTM Designation A532-65T. The composition range covered in this specification was 2.4% to 3.6% carbon, 0.4% to 0.9% manganese, 0.3% to 0.8% silicon, 0.5% (maximum) nickel, 14% to 18% chromium, 2.5% to 3.5% molybdenum, 0.10% (maximum) phosphorus and 0.06% maximum sulfur, balance essentially iron.

In the early 1060's, as the uses for the 15Cr-3Mo white iron expanded into heavy-section castings such as liners in large crushers and grinding mills, it became evident that there was a need to modify the alloy so that it would have greater depth hardening properties, i.e. greater pearlite suppressing power, when slowly cooled during the heat treatment normally required to develop optimum hardness and abrasion resistance in the castings. This was accomplished by the addition of about 1.0% copper or nickel and by raising the preferred chromium content to about 20% (see, for example, U.S. Pat. No. 3,410,682). The change also permitted the molybdenum content to be reduced to about 1.5% to 2.0% which lowered the total alloy cost for this high chromium iron. The modification containing about 1.0% copper is now favored by most producers and users of heavy-section castings and is known and will hereinafter be designated the 20Cr-2Mo-1Cu type of white iron.

Almost concurrently with the development of the 15Cr-3Mo alloy, as related above, A. P. Gagnebin et al., (U.S. Pat. No. 2,662,011) developed a competitive white iron composition with a similar structure of $Cr_7C_3$-type carbides dispersed in an austenite-martensite matrix. The specified composition contained 3.0% to 3.7% carbon, 0.5% to 3.0% silicon, 4.0% to 0.0% nickel and 6.8% to 15% chromium, added in balanced proportions according to the formula:

$$\%\,C + \frac{\%\,Ni}{28} + \frac{\%\,Cr}{24} + \frac{\%\,Si}{4} = 4.2 \text{ to } 5.0$$

This alloyed white iron, which is now commonly known as Ni-Hard 4, did not have as good abrasion resistance as the 15Cr-3Mo type or the 20Cr-2Mo-1Cu type of white iron, when tested in the laboratory wear tests or in most conditions of field service. It is generally believed that the somewhat inferior abrasion resistance of Ni-Hard 4 when compared to the 15Cr-3Mo or 20Cr-2Mo-1Cu white irons, is due to the relatively high nickel content of Ni-Hard 4, which tends to over-stabilize the austenite in the matrix of the structure. However, Ni-Hard 4 castings have an advantage for the producer of castings in that they develop their desired pearlite-free structure and are ready for use in their as-cast condition, in contrast to the 15Cr-3Mo or the 20Cr-2Mo-1Cu or the 27Cr types of white iron, which normally require a high temperature heat treatment, followed by an air quench, to develop their optimum abrasion resistance and toughness. For some castings and especially the larger size castings with relatively thick sections or complex configurations, it is difficult to perform the high temperature heat treatment without cracking or fracture of the castings during the heat treatment cycle.

In the early 1970's in cooperation with D. A. Stolk, I invented a nickel-free composition for a high-chromium white iron which, in its as-cast condition, had a matrix structure of austenite which could be partially transformed to martensite and thus hardened by refrigeration. This is described in U.S. Pat. No. 3,941,589. The composition contained about 2.5% to 3.5% carbon, about 2.5% to 3.5% manganese, about 12% to 22% chromium, about 1% to 2% silicon, about 1.5% to 3.0% molybdenum, about 1% to 2% copper, and the balance iron. The relatively high manganese content of 2.5% to 3.5% was used in this composition to suppress the formation of pearlite in the matrix of the cast structure. The abrasion resistance of this alloy in laboratory wear tests was at least equal to, and in some conditions superior to, Ni-Hard 4 in both the as-cast and the refrigeration-hardened conditions. However, this 2.5% to 3.5% manganese composition does not have as good abrasion resistance, when tested in the RWAT, or in gouging abrasion in a jaw crusher, as the alloy of my present invention. Furthermore, the 2.5% to 3.5% manganese composition has been found to have several production and quality control disadvantages, such as insufficient pearlite-suppressing power in heavy-section castings and a tendency for the relatively high manganese content to oxidize and be lost in the slag during the melting operation. As a result, it has not become a commercially popular alloy.

SUMMARY OF THE INVENTION

The present invention possesses the good qualities of the 15Cr-3Mo, the 20Cr-2Mo-1Cu and the Ni-Hard 4 types of white iron while avoiding their respective disadvantages. Specifically, the alloy of this invention, in its as-cast or refrigeration-hardened condition, has abrasion resistance and toughness equal to or better than the heat-treated 15Cr-3Mo and the 20Cr-2Mo-1Cu white irons. These highly desirable properties are attained by closely controlling and balancing the amount of each alloying constituent in the castings made from the alloy of the present invention, so that said castings in their as-cast condition, have a hard, highly abrasion resistant structure, which can then be further hardened and toughened and made even more abrasion resistant by subjecting said castings to a refrigeration-hardening treatment, whereby further beneficial transformations in the microstructure of the castings are effected.

The benefits and advantages of the present invention are achieved by a ferrous alloy possessed of excellent toughness and abrasion resistance in both the as-cast and refrigeration-hardened condition and which contains as its essential alloying constituents from about 2.6% to 3.6% carbon, about 12% to 22% chromium, about 0.5% to 1.1% manganese, about 1.0% to 3.0% molybdenum, about 0.5% to 1.5% copper along with approximately equal percentages of nickel and silicon in amounts ranging from about 1.4% to about 2.5%, along with normal residual elements and incidental impurities present in the usual amounts. In accordance with a preferred embodiment of the present invention, the alloy contains from about 3.0% to 3.4% carbon, about 14% to 18% chromium, about 0.6% to 0.9% manganese, about 1.6% to 2.0% molybdenum, about 0.9% to 1.1% copper, about 1.5% to 1.9% nickel and about 1.5% to 1.9% silicon, the balance essentially iron.

The combination of the essential alloying elements in the proportions specified minimizes or completely suppresses the formation of pearlite in the austenitic matrix of the as-cast microstructure, as the castings cool slowly in their sand molds. As the castings cool between about 570° F. (300° C.) and room temperature the relatively high silicon content of the alloy promotes partial transformation of the austenite in the matrix to martensite. Upon refrigeration, at temperatures usually below −100° F. (−75° C.), additional austenite is transformed to martensite. The presence of the relatively high silicon content is particularly effective in promoting this transformation of the retained austenite to martensite. This transformation contributes to the excellent abrasion resistance of the castings which in combination with their toughness, high strength and corrosion resistance renders them eminently suitable for a wide range of uses as components of devices exposed to a high degree of abrasion. Such devices include, for example, slurry pumps, coal grinders, grinders of lignocellulosic material such as wood chips and agricultural products, and so forth.

Additional benefits and advantages of the present invention will become apparent upon reading of the description of the preferred embodiments taken in conjunction with the specific examples provided.

DESCRIPTION

The acceptable and the preferred composition ranges of the white cast iron of the present invention are set forth in Table I.

TABLE I

White Cast Iron Alloy Composition-Percent By Weight

| Element | Usable Range, % | Preferred Range, % |
|---|---|---|
| Carbon | 2.6–3.6 | 3.0–3.4 |
| Chromium | 12.0–22.0 | 14.0–18.0 |
| Manganese | 0.5–1.1 | 0.6–0.9 |
| Molybdenum | 1.0–3.0 | 1.6–2.0 |
| Copper | 0.5–1.5 | 0.9–1.1 |
| Nickel | 1.4–2.5 | 1.5–1.9 |
| Silicon | 1.4–2.5 | 1.5–1.9 |
| Iron | Balance | Balance |

The principal alloying constituent of the white cast iron is chromium, which may range from about 12% to about 22%. When the chromium content of the iron is above 10%, the carbide crystals formed, when the iron solidifies from its molten state, are of the $Cr_7C_3$, rather than the $Fe_3C$ type which is formed in lower chromium or unalloyed white irons. The $Cr_7C_3$-type carbides in white irons containing over 12% chromium tend to form a discontinuous phase surrounded by a matrix of austenite and/or its transformation products, (ie, pearlite, spheroidite, bainite and martensite). This matrix is relatively tough and ductile, which contributes substantially to the overall toughness of the white iron. On the other hand where the chromium in the white iron is below about 10%, the $Fe_3C$-type carbide forms the continuous phase in the structure of the iron. Since the $Fe_3C$ phase is relatively brittle, it follows that a white iron containing less at 10% chromium is normally more brittle than a white iron, of equivalent carbon content, containing more than 10% chromium. The change from the $Fe_3C$ continous phase to the $Cr_7C_3$ discontinuous phase in a white iron normally occurs when the chromium is increased from about 10% to about 12% so the minimum chromium content in the alloy of this invention is specified at 12%. On the other hand, quantities of chromium in excess of about 22% are undesirable because the amount of carbon which can be added to maximize abrasion resistance is limited due to poor toughness in high chromium alloys containing high carbon.

The amount of carbon is controlled within about 2.6% to about 3.6% and preferably within a range of about 3.0 to about 3.4%. Quantities of carbon below about 2.6% are generally undesirable because inadequate hardness and abrasion resistance are exhibited by the resultant casting. At carbon contents above about 3.6% an excessive amount of coarse carbide needles, which reduce toughness, are present in the microstructure. In view of the foregoing, it is preferred to control the carbon content between a range of about 3.0% to about 3.4% which produces an optimum combination of abrasion resistance and toughness.

The manganese alloying constituent is controlled between a range of about 0.5% and 1.1% or preferably between 0.6% and 0.9%. These are normal ranges for manganese in high chromium iron castings. The function of manganese in this range is to neutralize the harmful effects of sulfur, which is practically always present as an impurity in small amounts, preferably under 0.05%, in white iron compositions. A further function of the manganese is to assist the molybdenum, copper and nickel in suppressing formation of pearlite in the matrix structure of the casting as it cools slowly in its mold after solidification. The presence of manganese over about 1.1% is undesirable, since a higher manganese content, when present in conjunction with the nickel and copper in the composition, tends to over-stabilize the austenite in the matrix of the structure so that it is too stable to transform to martensite when the casting is refrigerated at temperatures of −100° F. (−75° C.) or lower.

The molybdenum alloying constituent contributes hardness and abrasion resistance to the resultant casting and in combination with the manganese, copper and nickel in the composition, presents the formation of pearlite in the matrix during the cooling of large or complex commercial castings as they cool slowly to room temperature after solidification in their sand molds. Quantities of molybdenum less than about 1.0% are insufficient to obtain full pearlite suppression in large, heavy-section castings, while on the other hand, amounts greater than 3.0% are not needed to obtain the desired suppression of pearlite in heavy sections. For most commercial castings, the preferred range of about 1.6% to about 1.9% molybdenum is adequate to obtain full pearlite suppression, when used in conjunction with the preferred ranges of manganese, copper, and nickel. The use of about 1.0% to about 3.0% molybdenum as an alloying constituent is particularly beneficial, since such use effectively suppresses formation of pearlite in the matrix while at the same time it has practically no tendency to over-stabilize the austenite in the matrix after it has cooled down to room temperature or to refrigeration temperatures.

The copper alloying constituent has a synergistic effect when used in conjunction with molybdenum, so that the combination of these two elements is very effective in suppressing formation of pearlite in the matrix. Copper, when added in the preferred range of 0.9% to 1.1%, effectively helps to suppress transformation of the austenitic matrix to pearlite during cooling of the casting, while its tendency to stablilize the austenite and prevent its transformation to martensite at room temperature or refrigeration temperatures is relatively mild. Due to the limited solubility of copper in the solid austenitic phase of the iron, its use should be limited to about 1.5% maximum.

The nickel and silicon alloying constituents are interdependent so should be considered together as an essential pair in the present invention. The favorable and desired effect of nickel, in the ranges here specified, is to prevent transformation of austenite to pearlite as the casting cools in its sand mold between 1300° F. (704° C.) and about 1000° F. (538° C.). A specific quantity of nickel is more effective than the same quantity of manganese, molybdenum or copper in this respect. On the other hand the nickel has the undesired effect of lowering the martensite-start (Ms) temperature of the austenite as the casting cools to room temperature or lower, so that the austenite is stabilized and fails to transform to the harder, more abrasion-resistant martensite. I have discovered that this undesirable austenite-stabilizing effect of nickel, when present in the quantities specified herein, can be neutralized by adding approximately equal quantities of silicon to the composition described herein. The silicon tends to raise the $M_s$ temperature of austenite so that in castings made from the alloy of this invention, a substantial portion of the austenite in the structure of the castings has transformed to martensite by the time the castings have reached room temperature. The silicon, when present in amounts of about 1.4% to about 2.5%, is particularly effective in promoting further transformation of retained austenite to martensite, when the castings made from the alloy of this invention are cooled to sub-zero temperatures. The castings made from the alloy of this invention are therefore hardenable and made more abrasion-resistant by refrigeration, preferably at temperature of about −100° F. (−75° C.) or lower.

In the past, the silicon content of the high chromium irons, such as those of the 15Cr-3Mo and 20Cr-2Mo-1Cu types previously described, was held in the preferred range of about 0.5% to 0.8% with a maximum of 1.0% allowed. The silicon was purposely held down to these limits since higher silicon contents tend to promote the transformation of austenite to pearlite in the matrix of high chromium white iron castings. However in the white iron composition of the present invention, which contains from about 1.4% to about 2.5% silicon, the pearlite-forming tendency of this relatively high silicon content is effectively neutralized by the presence of an equal amount of nickel in the composition. It is evident therefore, that in the alloy of this invention, the nickel benefits the final structure and abrasion resistance of the casting by preventing the formation of pearlite and by neutralizing the pearlite-forming tendencies of high silicon contents, while the silicon raises the Ms temperature of the austenite and thus makes it refrigeration-hardenable and more abrasion-resistant.

The remainder of the alloy consists essentially of iron along with incidental impurities and normal residual elements in usual amounts. Included among conventional impurities are phosphorus and sulfur, which can be tolerated up to about 0.10% and 0.04% respectively, without adverse effects on the properties of the cast iron.

Heats made from the alloy of this invention are normally cast at temperatures of about 2500° F. (1370° C.) to 2600° F. (1425° C.) into sand molds. The molten metal solidifies in the mold between about 2250° F. (1230° C.) and 2200° F. (1205° C.). The castings should be allowed to cool down to, or near to room temperature before they are removed from their sand molds.

The relatively slow cooling rate in the molds prevents the buildup of high internal stresses, which if excessive, could cause the casting to crack.

The alloy of this invention is designed so that castings made from this alloy, after cooling to room temperature will have a structure of fine-grained $Cr_7C_3$-type carbides, which are very hard and abrasion-resistant, in a matrix of austenite which has partially transformed to martensite. In their as-cast condition, these castings normally have a hardness in the range of 520 to 560 Brinell. It is usual practice to stress relieve the as-cast castings at about 400° F. (205° C.) which does not significantly change their hardness or abrasion resistance. The retained austenite in the structure of these as-cast castings is metastable, so that it transforms quite readily to martensite when it is plastically deformed by abrasive forces acting on the wearing surface of a casting. As a consequence, the abrasion resistance of as-cast castings made from the alloy of this invention is very good and is generally superior to that of as-cast castings made from the type 4 Ni-Hard or the 15Cr-3Mo type or the 20Cr-2Mo-1Cu type alloys previously described.

Cast components composed of the high-alloy white cast iron of the present invention can be satisfactorily employed in their "as-cast" condition. Generally, however it is preferable to refrigerate these "as-cast" castings at sub-zero temperatures, which further increases their hardness and abrasion resistance. The refrigeration treatment, when followed by a stress-relieving tempering treatment at about 400° F. (205° C.), also increases resistance of the castings to spalling or breakage when they are used in high repeated-impact types of service.

The refrigeration-hardening treatment of castings, made from white cast iron of the present invention, may be accomplished by a variety of techniques. Cold chambers are commercially available which use a refrigeration cycle to cool a load of castings to as low as −140° F. (−96° C.) within a reasonable time, which may range from about one hour to about five or six hours, depending on the weight of the load and the maximum thickness of the castings. The sub-zero transformation of metastable austenite to martensite is a function of temperature, so as soon as the castings are cooled down to the desired temperature they may be removed from the cold chamber and allowed to warm up slowly to room temperature. Following this, the castings shoud be stress relieved by heating them slowly and uniformly to about 400° F. (205° C.), then held at this temperature for a period of about one hour per inch of maximum section, then air cooled back to room temperature.

Other means of cooling castings to sub-zero temperatures include immersion in a mixture of dry ice and organic solvent, which produces temperatures of about −100° F. (−75° C.) or by placing the castings in a chamber cooled by liquid nitrogen, which produces temperatures as low as −320° F. (−196° C.). Following the cooling of the castings by either of these techniques, they should be given a stress-relieving temper at about 400° F. (205° C.), as previously described.

To further illustrate the high-alloy white cast iron composition of the present invention, the following examples are provided. It will be understood that the examples are provided for illustrative purposes and are not intended to be limiting of the scope of the invention, as herein described and as set forth in the subjoined claims.

EXAMPLE 1

Two 125 pound heats having compositions within the range specified for the alloys of this invention were prepared by melting in an induction furnace. They were poured at about 2500° F. (1370° C.) into baked sand molds to produce castings measuring 1-inch by 6 inches by 8 inches, which were allowed to cool slowly to room temperature while in the mold. The heats are hereinafter designated as heats A and B. One casting from each heat was stress-relieved at 425° F. (220° C. for two hours to simulate the so-called "as-cast" condition. The other casting from each heat was refrigerated at −100° F. (−75° C.) for two hours and thereafter stress relieved at 425° F. (220° C.) for two hours to simulate a "refrigeration-hardened" condition.

The chemical analysis, solidification temperatures, matrix microstructure and hardness of the castings made from each of these heats are set forth in Table 2, which follows.

TABLE 2

Composition, Microstructure, and Hardness of Heats A and B Cast as 1-inch by 6-inch by 8-inch Castings

| | Heat A | Heat B |
|---|---|---|
| Composition (Percent) | | |
| Carbon | 3.39 | 3.20 |
| Chromium | 11.84 | 16.68 |
| Manganese | 0.53 | 0.77 |
| Molybdenum | 1.85 | 2.06 |
| Copper | 0.98 | 0.96 |
| Nickel | 2.01 | 2.02 |
| Silicon | 1.73 | 1.82 |
| Sulfur | 0.046 | 0.043 |
| Phosphorus | 0.036 | 0.036 |
| Iron | Balance | Balance |
| Solidification Temperatures (°F.) | | |
| Liquidus | 2155 | 2240 |
| Solidus | 2080 | 2240 |
| Matrix Microstructures* | | |
| As-Cast | 75% A. 20% M. 5% P | 85% A. 15% M |
| Refrigerated at −100° F. (−75° C.) | 55% M. 40% A. 5% P | 50% M. 50% A |
| Hardness | | |
| As-Cast | 564 HB | 545 HB |
| Refrigerated at −100° F. (−75° C.) | 670 HB | 653 HB |

*A = Austenite;
M = Martensite;
P = Pearlite

It is evident from the data in Table 2 that the refigeration treatment on both heats A and B transformed a substantial portion of the austenite present in the matrix of the as-cast structures to martensite. Also in both cases the refrigeration treatment increased the hardness of the castings by more than 100 Brinell points.

It should be noted that the matrix microstructure of the Heat A casting contained about five percent pearlite, which probably reduced the abrasion resistance of the structure by a small amount. To avoid formation of perarlite, the composition of Heat B is preferable to that of Heat A. The lower percentage of carbon and the higher percentages of chromium and manganese in Heat B all tend to suppress the formation of pearlite in the structure, as the castings cool slowly from their solidification temperature.

The as-cast casting and the refrigeration-hardened casting from each heat were sectioned to provide small test specimens, each ½ by 1 by 2¼ inches, for evaluation of their abrasion resistance in the "Rubber Wheel Abrasion Test", (RWAT), which is a standardized laboratory test fully described in Society of Automotive Engineers Publication No. 700687. Briefly, the test comprises pressing a weighed test specimen, with a force of 50 pounds, against a 7-inch diameter rubber-coated wheel rotating in a silica sand slurry at a speed of 240 rpm. The slurry consists of 940 grams of water and 1500 grams of AFS 50-70 testing sand. The abrasive sand slurry is discarded after each 5000 revolution test run and is replaced with a fresh slurry. Conventionally three tests are performed on each specimen, employing wheels of different rubber durometer hardness. At the completion of each test run the specimen is cleaned and reweighed to determine the weight of metal lost during the test. The weight lost on each of the three test runs is plotted against rubber durometer hardness, on semi-log graph paper, to provide a value of weight loss when employing a wheel coated with 55 Durometer hardness rubber.

The weights lost by the as-cast and the refrigeration-hardened test specimens from heats A and B, together with their hardness, are set forth in Table 3. The results obtained from prior investigations on other types of commercially popular high-chromium white irons are included for comparison. All of the Rubber Wheel Abrasion Test results in Table 3 were obtained at the Research Laboratory of Climax Molybdenum Company in Ann Arbor, Mich. The wear tests were conducted by using identical procedures for each test. All RWAT wear test specimens were cut from 1-inch thick cast plates. The alloys are listed in order of decreasing resistance to abrasion in the RWAT.

TABLE 3

Rubber Wheel Abrasion Values of Sand Cast One-Inch-Thick Alloy White Iron Plates

| Heat | White Iron Type | Condition | Hardness (BHN) | RWAT Weight Loss (mg) |
|---|---|---|---|---|
| B-1 | Present Invention 17% Cr | Refrig. to −100° F. | 653 | 36 |
| B-2 | Present Invention 17% Cr | As-Cast | 545 | 44 |
| A-1 | Present Invention 12% Cr | Refrig. to −100° F. | 670 | 44 |
| A-2 | Present Invention 12% Cr | As-Cast | 564 | 46 |
| 4580 | 15 Cr—2 Mo—1 Cu (3.32C) | Austen. 1750° F., aircooled | 760 | 47 |
| 4581 | 20 Cr—2 Mo—1 Cu (2.89C) | Austen. 1750° F., aircooled | 757 | 51 |
| 5075 | Ni-Hard 4 (3.42C) | Refrig. to −100° F. | 606 | 51 |
| 5075 | Ni-Hard 4 (3.42C) | As-Cast | 488 | 55 |
| 4477 | 27 Cr—0.5 Mo (3.10C) | Austen. 1850° F., aircooled | 709 | 65 |
| 4461 | 27 Cr—0.5 Mo (2.58C) | Austen. 1850° F., aircooled | 650 | 76 |
| 4460 | 27 Cr (2.58C) | Austen. 1850° F., aircooled | 642 | 99 |

It is evident from the weight loss data in Table 3 that the refrigeration-hardening treatment on the two alloys of my present invention (Heats B-1 and A-1 respectively) improves their abrasion resistance over that of the corresponding as-cast alloys. Also, the abrasion resistance, as measured in the RWAT, of both the refrigerated and as-cast alloys of this invention is better than that of any of the seven other types o high-alloy white iron listed in Table 3. These seven other types present the grades which have heretofor been most pupular for the commercially-produced white iron castings used in pumps handling abrasive slurries, in coal-grinding equipment, in pulp mill refiner segments and in many other applications where abrasive wear is of the "low-stress" or scratching type. The RWAT is the test most frequently used to evaluate abrasion resistance of materials used in low-stress scratching abrasion.

A further advantage of the alloys of this invention and particularly the alloy represented by Heat B-1 in Table 3, is that high abrasion resistance is achieved without the need for high temperature heat treatments. Large castings or castings with a complex configuration are often prone to cracking during the heating or cooling cycles involved in high temperature heat treatments, such as those required for best abrasion resistance of the 15Cr-2Mo-1Cu, the 20Cr-2Mo-1Cu and the 27Cr types listed in Table 3.

The Ni-Hard 4 type of iron is a refrigeration-hardenable type, as indicated in Table 3, but its abrasion resistance was about 42% less than that of the alloy of my present invention, as represented by Heat B-1 in Table 3.

EXAMPLE 2

In this example the properties of a 4-inch thick casting, when made from the alloy of this invention, hereinafter designated Heat C, are compared to Ni-Hard 4 which was also cast as a 4" thick casting. One 125 pound heat of each alloy was cast into a 4-inch by 6-inch by B-inch block employing a baked sand mold which was fed from the bottom. Each block was allowed to cool slowly to room temperature while in the mold. Specimens for the Rubber Wheel Abrasion Test, as described in Example 1, were cut from each cast block by trepanning with an electrical discharge machine to produce 1⅛ inch diameter cylinders. One specimen from each block was stress relieved at 425° F. (220° C.) for two hours, simulating the "as-cast" condition. The other specimen from each block was refrigerated at −100° F. (−75° C.) for two hours simulating a refrigeration-hardened condition. The microstructure, hardness and abrasion resistance in the RWAT were then determined for each specimen. The results are set forth in Table 4.

TABLE 4

Composition, Microstructure, Hardness and Weight Loss on the RWAT of Heat C and Ni-Hard 4, Cast as 4-inch by 6-inch by 8-inch Castings

| | Heat C | Ni-Hard 4 |
|---|---|---|
| Composition (Percent) | | |
| Carbon | 3.08 | 3.43 |
| Chromium | 15.95 | 8.49 |
| Manganese | 0.72 | 0.70 |
| Molybdenum | 1.83 | ND* |
| Copper | 0.90 | ND* |
| Nickel | 1.96 | 6.22 |

TABLE 4-continued

Composition, Microstructure, Hardness and Weight Loss on the RWAT of Heat C and Ni-Hard 4, Cast as 4-inch by 6-inch by 8-inch Castings

| | Heat C | Ni-Hard 4 |
|---|---|---|
| Silicon | 1.49 | 1.61 |
| Sulfur | 0.047 | 0.031 |
| Phosphorus | 0.033 | 0.035 |
| Iron | Balance | Balance |
| Solidification Temperatures (°F.) | | |
| Liquidus | 2250 | 2180 |
| Solidus | 2220 | 2120 |
| Matrix Microstructures** | | |
| As-Cast | 75% A, 20% M, 5% SC | 75% A, 20% M 5% SC |
| Refrigerated at −100° F. (−75° C.) | 60% M, 35% A, 5% SC | 70% M, 25% A, 5% SC |
| Hardness | | |
| As-Cast | 555HB | 506HB |
| Refrigerated at −100° F. (−75° C.) | 676HB | 637HB |
| RWAT Weight Loss (mg) | | |
| As-Cast | 63 | 142 |
| Refrigerated at −100° F. (−75° C.) | 55 | 160 |

*ND = Not determined since none added to heat
**A = Austenite; M = Martensite; P = Pearlite Due to their heavier-section size, the 4-inch-thick castings listed in Table 4 solidified more slowly and cooled in their molds more slowly than the 1-inch-thick castings listed in Tables 2 and 3 of Example 1. A comparison of the the RWAT weight losses in Table 3 with the weight losses of the corresonding alloys in Table 4 indicates that as the section size of the castings increases, their abrasion resistance is reduced. However, this loss in abrasion resistance was much greater on the Ni-hard 4 castings listed in Table 4 than it was on Heat C, which represents the preferred alloy of this invention. For example the specimen from Heat C, refrigeration-hardened, lost 55 milligrams on the RWAT, while the Ni-Hard 4 specimen, refrigerated-hardened, lost 160 milligrams under the same test conditions. The superiority in the RWAT of the preferred alloy of this invention (Heat C), over Ni-Hard 4, as demonstrated in Table 4, is again evident, as it was in Table 3 of Example 1.

The microstructure and hardness values of the Heat C specimens in Table 4 indicate that the preferred alloy of this invention, when cast in 4-inch sections, develops the desired pearlite-free structure and responds well to refrigeration-hardening to produce castings having outstanding abrasion resistance.

EXAMPLE 3

In this example a heat of the preferred alloy of this invention was melted in a commercial-size, direct arc electric furnace at Mason & Cox Foundry in Adelaide, Australia. The heat was cast into sand molds to produce liner plates 2 inches and 4 inches thick and also dredge pump impellers. After cooling to room temperature in their molds, two of the 2-inch-thick castings were selected for laboratory studies. One casting was cooled slowly to −310° F. (−190° C.), held for six hours at this temperature, using liquid nitrogen as the coolant, then allowed to warm up to room temperature, then stress-relieved at 400° F. (205° C.). The other casting was heated slowly to 1760° F. (960° C.), held for two hours at this temperature, then air quenched to room temperature, then stress-relieved at 400° F. (205° C.). Sections were then cut from each casting for determination of microstructure, hardness and abrasion resistance in the Rubber Wheel Abrasion Test. The sections were tested at the Broken Hill Proprietary (BHP) Research laboratory in Melbourne, Australia, then at the wear-testing laboratory of the U.S. Bureau of Mines in Albany, Ore. The RWAT at the BHP Laboratory followed the same standard procedure as that used for the previously-described tests at the Climax Molybdenum Company Laboratory in Ann Arbor, Mich., except that the silica sand used in the BHP tests was not quite as abrasive as the sand used in the prior tests in Michigan. The RWAT at the U.S. Bureau of Mines in Albany used dry silica sand as the abrasive and followed "Procedure B" as specified by ASTM C65-80 Standard Practice.

The heat from which the castings, representing the preferred alloy of this invention, were made at the Mason and Cox foundry, will hereinafter be identified as Heat MC. The results of the laboratory studies made on the said castings and the test specimens cut from the said castings are summarized in Table 5.

TABLE 5

Composition, Hardnesses, Microstructures and RWAT Weight Losses of Specimens cut from Two-inch Thick Castings made from Heat MC

| | Heat MC |
|---|---|
| Composition (Percent) | |
| Carbon | 3.07 |
| Chromium | 17.27 |
| Manganese | 0.75 |
| Molybdenum | 2.01 |
| Copper | 0.89 |
| Nickel | 1.76 |
| Silicon | 1.66 |
| Sulfur | 0.03 (approx.) |
| Phosphorus | 0.02 (approx.) |
| Iron | Balance |
| Matrix Microstructures | |
| As-Cast | Austenite plus Martensite |
| Refrigerated at −310° F. (−190° C.) | Martensite plus Austenite |
| 1760° F., Air Quenched | Martensite plus Secondary Carbides |
| Hardness | |
| As-Cast | 53Rc (540HB) |
| Refrigerated at −310° F. (−190° C.) | 59Rc (640HB) |
| 1760° F., Air Quenched | 63Rc (710HB) |
| RWAT Weight Losses (mg) | |
| BHP Lab. (Sand Slurry) Refrigerated at −310° F. (−190° C.) | 21.6 |
| BHP Lab. (Sand Slurry) Aust. 1760° F., Air Quenched | 21.6 |
| USB of M Lab. Dry Sand Refrigerated at −310° F. (−190° C.) | 70.6 |

It is evident from Table 5 that the castings from Heat MC responded well to the refrigeration-hardening treatment. To provide a comparison of relative abrasion resistance on the Sand Slurry RWAT, one casting from Heat MC was given the high temperature heat treatment (1760° F. plus air quench), normally used to fully-harden castings made from the 15Cr-3Mo and 20Cr-2Mo-1Cu types of white iron. As indicated in Table 5, the casting from Heat MC hardened to 63Rc when given the high-temperature heat treatment, but in spite of its higher hardness, its abrasion resistance on the RWAT at the BHP laboratory was the same as that of the refrigeration-hardened specimen.

To provide a comparison between the RWAT abrasion resistance of the castings from Heat MC and other high-alloy white iron abrasion-resistant castings, when tested at the BHP laboratory and at the U.S. Bureau of Mines laboratory, the wear rates (weight losses) from prior wear tests are set forth in Table 6. The alloy white iron types are listed in descending order of abrasion resistance, as determined in both the sand slurry and dry sand Rubber Wheel Abrasion Tests.

TABLE 6

Rubber Wheel Abrasion Values of Sand Cast Alloy White Iron. 1-inch to 2-inch Thick Plates When Tested at the BHP Laboratory and the U.S. Bureau of Mines Laboratory

| White Iron Type | Condition | Hardness* (BHN) | Sand Slurry RWAT Weight Loss at BHP (mg) | Dry Sand RWAT Weight Loss at USB of M (mg) |
|---|---|---|---|---|
| Present Invention, Heat MC | Refrig. to −310° F. (−190° C.) | 640 | 21.6 | 70.6 |
| Present Invention, Heat MC | Aust. 1760° F., Air Quench | 710 | 21.6 | N.D. |
| 15 Cr—3 Mo, 3.0–3.3% C | Aust. 1760° F., Air Quench | 745–760 | 21 to 28 | 68 to 84 |
| Ni-Hard 4, 3.1% C | As-Cast | 520 | 32.8 | 95 |
| 27Cr. 2.7% C | Aust. 1850° F., Air Quench | 745 | 46.0 | 96 |

*Hardness as reported on BHP tests.

The wear test results in Table 6 place the four white iron type listed in exactly the same order of merit as they occurred in Example 1, Table 3. Specifically the alloy of the present invention (Heat MC), refrigeration-hardened, stands highest in order of merit, as determined in both the Sand Slurry RWAT and the Dry Sand RWAT.

The three foregoing examples reveal that the alloy of the present invention has excellent resistance to abrasion when compared to prior-art types of abrasion-resistant white cast irons. Furthermore the alloy of the present invention shows good response to the refrigeration-hardening treatments, so that it is not necessary to use a high temperature heat treatment on the alloy, such as is used on most of the high-chromium types of abrasion-resistant white irons. The elimination of the need for high temperature heat treatment is a great advantage in the production of large castings or of castings with a complex configuration, which are often prone to cracking during the high temperature heat treatment. It should also be noted that the alloy of the present invention has substantially better abrasion resistance than Ni-Hard 4, especially in heavy section castings where in the past, Ni-Hard 4 castings have been extensively used in their as-cast or refrigeration-hardened condition.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An abrasion-resistant refrigeration-hardenable ferrous alloy consisting essentially of about 2.6% to about 3.6% carbon, about 12% to about 22% chromium, about 0.5% to about 1.1% manganese, about 1.0% to about 3.0% molybdenum, about 0.5% to about 1.5% copper, about 1.4% to about 2.5% nickel, about 1.4% to about 2.5% silicon and the balance iron together with incidental impurities and normal residual elements present in the usual amounts.

2. The abrasion-resistant refrigeration-hardenable ferrous alloy as defined in claim 1, wherein carbon is present in an amount of about 3.0% to about 3.4%, chromium is present in an amount of about 14.0% to about 18.0%, manganese is present in an amount of about 0.6% to about 0.9%, molybdenum is present in an amount of about 1.6% to about 2.0%, copper is present in an amount of about 0.9% to about 1.1%, and nickel and silicon are each present in amounts of about 1.5% to about 1.9%.

3. The abrasion-resistant refrigeration-hardenable ferrous alloy as defined in claim 1, further characterized by a matrix microstructure free from pearlite and comprising a mixture of martensite and austenite in amounts depending on the cooling rate and temperature to which it is cooled following casting.

4. The abrasion-resistant refrigeration-hardenable ferrous alloy of claim 1 wherein said nickel and silicon are each present in substantially equal amounts.

5. An abrasion-resistant article in a refrigeration-hardened state consisting essentially of about 2.6% to about 3.6% carbon, about 12% to about 22% chromium, about 0.5% to about 1.1% manganese, about 1.0% to about 3.0% molybdenum, about 0.5% to about 1.5% copper, about 1.4% to about 2.5% nickel, about 1.4% to about 2.5% silicon and the balance iron together with incidental impurities and normal residual elements present in the usual amounts.

6. The abrasion-resistant article in a refrigeration-hardened state as defined in claim 5, wherein carbon is present in an amount of about 3.0 to about 3.4%, chromium is present in an amount of about 14.0% to about 18.0%, manganese is present in an amount of about 0.6% to about 0.9%, molybdenum is present in an amount of about 1.6% to about 2.0%, copper is present in an amount of about 0.9% to about 1.1%, and nickel and silicon are each present in amounts of about 1.5% to about 1.9%.

7. The article as defined in claim 5 in the form of a component in a pump device.

8. The article as defined in claim 5 in the form of a component in a coal grinding device.

9. The article as defined in claim 5 in the form of a component in a grinding device for lignocellulosic materials.

10. The article as defined in claim 5, having a Brinell hardness greater than about 600.

11. The article as defined in claim 5 wherein said nickel and silicon are each present in substantially equal amounts.

* * * * *

UNITED STATES PATENT AND TRADEMARK OFFICE

CERTIFICATE OF CORRECTION

PATENT NO. : 4,547,221

DATED : October 15, 1985

INVENTOR(S) : Telfer E. Norman

It is certified that error appears in the above-identified patent and that said Letters Patent is hereby corrected as shown below:

Col. 2, line 39 Change "0.0%" to --8.0%--.

Col. 7, line 47 Change "shoud" to --should--.

Col. 8, line 61 Change "perarlite" to --pearlite--.

Col. 9, line 61 Change "o" to --of--.

Col. 10, line 25 Change "B-inch" to --8-inch--.

Signed and Sealed this

*Thirty-first* Day of *December 1985*

[SEAL]

*Attest:*

*Attesting Officer*

DONALD J. QUIGG

*Commissioner of Patents and Trademarks*